US005308599A

United States Patent [19]

Kawamura et al.

[11] Patent Number: 5,308,599

[45] Date of Patent: May 3, 1994

[54] PROCESS FOR PRODUCING PITCH-BASED CARBON FIBER

[75] Inventors: Toshifumi Kawamura; Takashi Maeda, both of Ibaraki, Japan

[73] Assignee: Petoca, Ltd., Tokyo, Japan

[21] Appl. No.: 912,850

[22] Filed: Jul. 13, 1992

[30] Foreign Application Priority Data

Jul. 18, 1991 [JP] Japan ..... 3-202130

[51] Int. Cl.[5] ..... D01F 9/12

[52] U.S. Cl. ..... 423/447.4; 423/447.1; 208/39

[58] Field of Search ..... 208/39, 44; 423/447.4, 423/447.6, 447.1; 264/29.2

[56] References Cited

U.S. PATENT DOCUMENTS

| | | | |
|---|---|---|---|
| 4,096,056 | 6/1978 | Haywood et al. | 208/39 |
| 4,487,685 | 12/1984 | Watanabe | 208/44 |
| 4,512,874 | 4/1985 | Watanabe | 208/44 |
| 4,529,498 | 7/1985 | Watanabe | 208/44 |
| 4,529,499 | 7/1985 | Watanabe | 208/44 |
| 4,606,872 | 8/1986 | Watanabe | 264/29.2 |
| 4,814,121 | 3/1989 | Watanabe | 423/447.1 |
| 4,892,722 | 1/1990 | Suto et al. | 423/448 |
| 4,898,723 | 2/1990 | Suto et al. | 423/447.1 |
| 4,902,492 | 2/1990 | Beneke et al. | 208/39 |
| 4,913,889 | 4/1990 | Takai et al. | 423/447.1 |
| 4,975,261 | 12/1990 | Takabatake | 423/445 |
| 4,975,262 | 12/1990 | Suto et al. | 423/447.1 |
| 4,986,943 | 1/1991 | Sheaffer et al. | 423/447.6 |
| 5,004,511 | 4/1991 | Tamura et al. | 423/447.1 |
| 5,035,942 | 7/1991 | Nagata et al. | 428/288 |
| 5,071,631 | 12/1991 | Takabatake | 423/445 |
| 5,091,164 | 2/1992 | Takabatake | 423/445 |

FOREIGN PATENT DOCUMENTS

| | | | |
|---|---|---|---|
| 0016661 | 10/1980 | European Pat. Off. | |
| 90970 | 10/1983 | European Pat. Off. | 208/44 |
| 601905 | 5/1948 | United Kingdom | |
| 1080866 | 8/1967 | United Kingdom | |

*Primary Examiner*—Michael Lewis
*Assistant Examiner*—Stuart L. Hendrickson
*Attorney, Agent, or Firm*—Oblon, Spivak, McClelland, Maier & Neustadt

[57] ABSTRACT

There is disclosed a process for producing pitch-based carbon fiber which comprises melt spinning an optically isotropic pitch or a mesophase pitch to form pitch fiber; subjecting the pitch fiber to liquid-phase oxidative polymerization in a solvent in the presence of an acid catalyst and a crosslinking agent to form infusibilized fiber; and carbonizing the infusiblized fiber. The above process enables low temperature and short time infusibilizing treatment of optically isotropic pitch fiber having a low softening point which has heretofore been difficult because of failure to preserve the original fibrous shape during infusibilization, and also efficient production of mesophase pitch-based carbon fibers as well as optically isotropic pitch-based carbon fibers each being improved in physical properties.

6 Claims, No Drawings

PROCESS FOR PRODUCING PITCH-BASED CARBON FIBER

BACKGROUND OF THE INVENTION

1. Field of the Invention

The present invention relates to a process for producing pitch-based carbon fibers. More particularly, it pertains to a process for efficiently producing pitch-based carbon fibers by liquid-phase oxidative polymerization of pitch fibers to easily infusibilize the fibers at a low temperature in a short time.

2. Description of Related Art

Pitch-based carbon fibers have heretofore been produced by firstly spinning a raw material pitch to form pitch fibers and then subjecting the resultant pitch fibers to oxidative polymerization in gaseous phase of air at an elevated reaction temperature of 160° to 180° C. or higher to form infusibilized fibers. With respect to the aforestated production process, however, in the case where there was used as raw material, a pitch having a softening point lower than the reaction temperature, especially an optically isotropic pitch, it was hardly possible to perform infusibilization treatment by reason of the high reaction temperature.

In the case of producing optically isotropic pitch-based carbon fibers, there is employed a raw material pitch comprising optically isotropic pitch as the principal component. The optically isotropic pitch, however, has involved the problem that because of its low softening point as well as a high contents of low molecular components, the infusibilizing treatment of the pitch fibers obtained by spinning the pitch causes the pitch fibers to melt during the treatment making it extremely difficult to preserve the original fibrous shape and thus to produce infusibilized fibers, and even if it is possible to produce infusibilized fibers, a long time is required.

As described hereinbefore, it is the present status of the conventional process for producing infusibilized fibers by gas-phase oxidative polymerization that the use of optically isotropic pitch as the raw material pitch makes it difficult to effect infusibilization at a high reaction temperature on account of the low softening point of the raw material pitch itself.

Aside from the foregoing, infusibilized fibers have heretofore been obtained by spinning mesophase pitch to form mesophase pitch fibers and subsequently subjecting the resultant fibers to oxidative polymerization in the air at a high temperature of about 200° to 400° C. However, since the above-mentioned process allows oxygen to penetrate to the inside of the fibers and decreases the orientation properties of the pitch molecules owing to the oxidation, growth of crystal is impaired in the later carbonization step and structural defect is brought about by the release of the introduced oxygen, thus causing difficulty in achieving the carbon fibers with high performance in physical properties.

In view of the above circumstances facing such difficulty, intensive research and investigation were concentrated by the present inventors into the development of a process enabling infusibilization of the pitch fibers even at a low reaction temperature by cancelling the disadvantages inherent to the conventional process.

As a result, it has been found that infusibilizing treatment is facilitated by subjecting the pitch fibers to liquid-phase oxidative polymerization under specific reaction conditions adjusted to a relatively low temperature to proceed with infusibilization. The present invention has been accomplished on the basis of the aforestated finding and information.

SUMMARY OF THE INVENTION

Accordingly, it is the primary object of the present invention to provide a process capable of infusibilizing treatment of optically isotropic pitch fibers with low softening points at a low temperature in a short time while preserving the original fibrous shape of the fibers.

It is another object of the present invention to provide a process capable of effectively producing optically isotropic pitch-based carbon fibers.

It is still another object of the present invention to provide a process capable of effectively producing mesophase pitch-based carbon fibers having excellent properties.

Other objects of the present invention will be obvious from the text of the specification hereinafter disclosed.

The present invention provides a process for producing pitch-based carbon fibers characterized by the steps of melt spinning a raw material pitch, especially a raw material pitch comprising optically isotropic pitch or mesophase pitch as the principal component to form pitch fibers; subsequently subjecting the resultant pitch fibers to liquid-phase oxidative polymerization in a solvent in the presence of an acid catalyst and a crosslinking agent to form infusibilized fibers; and thereafter carbonizing the infusibilized fibers thus obtained.

DESCRIPTION OF PREFERRED EMBODIMENT

In the present invention, a pitch, especially a pitch comprising optically isotropic pitch as the essential component is employed as the raw material and melt spun according to the conventional procedure to form pitch fibers. Subsequently the pitch fibers thus obtained are subjected to liquid-phase oxidative polymerization in a solvent in the presence of an acid catalyst and a crosslinking agent at a relatively low temperature.

The conventional gaseous phase oxidative polymerization has suffered from difficulty in preserving the original shape of the fiber in the case of optically isotropic pitch fibers having a low softening point being used as raw material because of infusibilizing treatment at an elevated temperature.

As opposed to the foregoing, the liquid-phase oxidative polymerization according to the present invention enables pitch fibers to be infusibilized at a low temperature in a short time with enhanced infusibilization efficiency even in the case of pitch fibers having a low softening point such as optically isotropic pitch fibers being employed as the object to be infusibilized.

In the present invention, there is preferably used as raw material pitch the pitch comprising an optically isotropic pitch as the principal component. The optically isotropic pitch is produced from petroleum pitch, coal pitch or the like through the treatment step of filtration, purification, distillation, hydrogenation, catalytic cracking, etc. according to the conventional process. As the optically isotropic pitch thus obtained, there may be used the pitch having a low softening point of 200° C. or lower as well as the pitch in ordinary use having a high softening point of 200° to 250° C. or higher. In addition to the above, there may be also employed the pitch comprising an optically isotropic pitch as the essential component which contains a small amount of mesophase pitch as the raw material pitch.

At the time when carbon fibers are produced by the use of the optically isotropic pitch as the raw material pitch, firstly the optically isotropic pitch is spun to afford pitch fibers. Any of spinning methods including publicly known melt-spinning methods may be adopted insofar as it is a method capable of spinning the optically isotropic pitch into fibrous form.

Secondly, the pitch fibers thus produced is subjected to infusibilizing treatment by liquid-phase oxidative polymerization reaction, which is put into practice under the conditions adjusted to a relatively low temperature in a solvent in the presence of both an acid catalyst and a crosslinking agent to form infusibilized fibers.

It is considered that the oxidative polymerization reaction for the infusibilizing treatment of the pitch fibers proceeds by the mechanism basically the same as that of the synthesis of phenolic resin.

In carrying out the infusibilizing treatment, any of crosslinking agents in any form is available without specific restriction inasmuch as it forms formaldehyde monomer in the reaction system. Examples of the above-mentioned crosslinking agents include aldehydes such as formalin in any concentration available on the market, paraformaldehyde and trioxane; and compounds each having a hydroxymethyl group. The preferably usable agent among them is paraformaldehyde that hardly decreases catalyst concentration and can be procured at a relatively low cost. Also, formaldehyde in gaseous form may be used by blowing it into the reaction system.

With regard to the acid catalyst to be employed in infusibilizing treatment, any of acid catalysts is acceptable without specific limitation provided that it is soluble in the solvent to be used in the present invention. Examples of the aforesaid acid catalyst include Lewis acids such as a strong inorganic acid such as sulfuric acid, nitric acid, hydrochloric acid and phosphoric acid; strong organic acid such as p-toluenesulfonic acid; and other Lewis acid such as boron trifluoride and aluminum chloride, among which strong organic acid such as p-toluenesulfonic acid is preferably used with respect to catalytic activity, handleability and the like.

As the solvent to be used in the reaction system, an acidic solvent is desirable from the viewpoint of the acid catalyst to be employed in the same reaction system. Among them, an organocarboxylic acid is particularly useful and specifically exemplified by acetic acid, propionic acid and butyric acid, of which acetic acid is particularly desirable in regard to the convenience in handling.

The proportion of each of the above-mentioned components to the raw material pitch comprising optically isotropic pitch as the essential component is not specifically limited in the present invention insofar as the reaction and the reaction conditions are properly maintained.

As a general rule, the amount of the crosslinking agent to be added to the reaction system is 0.05 to 0.25 mole per 1 g of the pitch fibers. The amount thereof less than 0.05 mole lowers the content of oxygen atoms in the system and results in failure to sufficiently proceed with oxidative polymerization reaction and produce the intended infusibilized fibers, whereas the amount exceeding 0.25 mole is unfavorable, since it extremely increases the content of oxygen atoms in the system, leading to excessive proceeding of the oxidative reaction. In the case where formaline is brought into use as the crosslinking agent, the number of moles thereof is expressed in terms of the number of moles of the corresponding formaldehyde.

The amount of the acid catalyst to be added to the reaction system is preferably 0.0025 to 0.125 mole per 1 g of the pitch fibers. The amount of the solvent to be added to the reaction system is not specifically limited.

The conditions of oxidative polymerization reaction for infusibilizing treatment according to the present invention are not specifically limited so long as the reaction proceeds to the extent that the optically isotropic pitch fibers preserve the original fibrous forms. In general, the reaction temperature is 100° to 150° C., desirably 100° to 130° C., and reaction time is 1 to 10 hours, desirably 2 to 5 hours.

The reaction temperature lower than 100° C. results in failure to sufficiently proceed with oxidative polymerization reaction, while the temperature higher than 150° C. leads to failure to preserve the original shape of the pitch fibers, causing difficulty in forming infusibilized fibers.

In the present invention, the equipment to be used for infusibilizing treatment by means of oxidative polymerization reaction is independent of form and shape thereof and may be of ordinary batch system or continuous-flow system provided that the equipment enables the reaction to continuously or separately proceed subsequently to the spinning step of pitch fibers.

According to the process of the present invention, the infusibilized fibers thus obtained can be carbonized, further graphitized as necessary, in accordance with a conventional process to produce pitch-based carbon fibers.

In the aforestated carbonization step according to the present invention, the reaction conditions may be selected in a variety of ways corresponding to the purpose of use of the carbon fiber to be produced. As a general rule, the infusibilized fiber is preferably heat treated in an atmosphere of an inert gas such as nitrogen or argon at a heat-up rate of 5 to 100° C./minute at a treatment temperature of 400° to 3,000° C., preferably 900° to 2,500° C.

According to the conventional gaseous phase oxidative polymerization process, the infusibilizing treatment of optically isotropic pitch fibers necessitates a high reaction temperature of 160° to 180° C. or higher and therefore, it is impossible to maintain the fibrous shape of the pitch having a softening point of lower than the above reaction temperature under such a high temperature condition, causing difficulty in the production of infusibilized fibers.

In contrast to the conventional process, the low temperature liquid-phase oxidative polymerization process according to the present invention enables infusibilizing treatment at a lower temperature of 100 to 150° C. in a short time while maintaining the original fibrous shape of pitch fiber, thereby making it possible to efficiently produce optically isotropic pitch-based carbon fibers.

In the process of the present invention, there is preferably used a raw material pitch comprising an optically isotropic pitch as an essential component, but there may be also employed as a raw material pitch, a pitch comprising a mesophase pitch as an essential component which pitch is produced from petroleum pitch, coal pitch or the like through the suitable selection from the treatment steps of filtration, purification, distillation, hydrogenation, catalytic cracking etc. according to the conventional process. By infusibilizing treatment of the above-mentioned pitch feed material by means of the aforestated oxidative polymerization reaction, there is obtained mesophase pitch-based carbon fibers which maintain the molecular orientation properties inherent to the pitch fibers and are improved in physical properties, inter alia tensile strength.

From the viewpoint of physical properties of fibers, it is preferable to utilize the raw material pitch comprising not less than about 70% mesophase pitch.

The process of the present invention should be put into practice by the use of raw material pitch comprising mesophase pitch as the essential component preferably under the oxidative polymerization reaction conditions including reaction temperature of 90° to 150° C. and reaction time of 0.1 to 10 hours. The amount of the crosslinking agent to be added to the reaction system is 0.0001 to 0.05 mole per 1 g of the mesophase pitch fibers. The amount thereof less than 0.0001 mole decreases the content of oxygen atoms in the system and results in failure to sufficiently proceed with oxidative polymerization reaction and produce the intended infusibilized fibers, whereas the amount exceeding 0.05 mole is unfavorable, since it extremely increases the content of oxygen atoms in the system, leading to excessive proceeding of the oxidative reaction, decrease in the orientation property of pitch molecules and failure to produce carbon fibers with high performance in physical properties.

The amount of the acid catalyst to be added to the reaction system is preferably in the range of 0.0001 to 0.05 mole per 1 g of the pitch fibers. The amount of the solvent to be added to the reaction system is not specifically limited.

According to the process of the present invention, the infusibilized fibers thus obtained can be carbonized in accordance with a conventional process to produce mesophase pitch-based carbon fibers.

As described hereinbefore, the process according to the present invention enables low temperature and short time infusibilizing treatment of optically isotropic pitch fibers having a low softening point which has been difficult by the conventional gaseous phase oxidative polymerization process because of incapability of preserving the original fibrous shape of the fibers, thus making it possible to efficiently produce optically isotropic pitch-based carbon fibers.

Furthermore, by applying the process of the present invention to mesophase pitch fibers, low temperature and short time infusibilizing treatment of the fibers is made possible, irregularity in the molecular orientation due to such treatment is suppressed and properly infusibilized fibers can be produced while maintaining the orientation as such at the time when the mesophase pitch fibers were formed. Consequently, according to the process of the present invention, the mesophase pitch-based carbon fibers with prominent physical properties can be produced in high efficiency as well.

Such being the case, the process of the present invention enables efficient production of optically isotropic pitch-based carbon fibers and mesophase pitch-based carbon fibers, which fibers are excellent in quality and effectively utilized as the raw materials for various moldings or reinforcing raw materials.

In the following the present invention will be described in more detail with reference to the examples and comparative examples. However, the scope of the present invention shall not be limited thereto.

EXAMPLE 1

By the use of an optically isotropic pitch having a softening point of 137° C. as measured with a flow tester as the raw material, a pitch fiber having 10.0 μm diameter was obtained by melt spinning method at a spinneret temperature of 160° C. and at a winding velocity of 300 m/min.

Then, to acetic acid as the solvent were added 0.015 mole (2.85 g) of p-toluenesulfonic acid (hereinafter abbreviated to "PTS") as the catalyst and 0.525 mole (15.75 g) of paraformaldehyde as the crosslinking agent to prepare a solution to be used for the subsequent reaction.

Thereafter, 3 g of the above-obtained pitch fiber was immersed in the above solution to effect reaction at 107° C. for 4 hours, then taken out from the solution and dried at 130° C. under vacuum to afford infusibilized fiber at a yield of infusibilization of 116.1% by weight.

The infusibilized fiber was heated to 800° C. in a stream of nitrogen to produce optically isotropic pitch-based carbon fiber maintaining the fibrous shape and free from fusing together at a yield of carbonization of 72.3% by weight. As to the physical properties of the carbon fiber thus obtained, it had a tensile strength of 76 $kgf/mm^2$ and a modulus of elasticity of $3.4\times10^3$ $kgf/mm^2$.

EXAMPLE 2

By the use of a pitch having a mesophase pitch content of 90% by weight and a softening point of 245° C. as measured with a flow tester as the raw material, a mesophase pitch fiber having 13 μm diameter was obtained by melt spinning method at a spinneret temperature of 320° C. and at a winding velocity of 170 m/min.

Then, to propionic acid as the solvent were added 0.075 mole of p-toluenesulfonic acid (PTS) as the catalyst and 0.075 mole of formalin expressed in terms of formaldehyde as the crosslinking agent to prepare a solution to be used for the subsequent reaction.

Thereafter, 3 g of the above-obtained mesophase pitch fiber was immersed in the above solution to effect reaction at 120° C. for 7 hours, then taken out from the solution and dried at 130° C. under vacuum to afford infusibilized fiber at a yield of infusiblization of 96% by weight.

The infusibilized fiber was graphitized at 2500° C. to produce graphitized fiber having 9.5 μm diameter at a yield of 81% by weight.

The graphitized fiber thus obtained had a tensile strength of 343 $kgf/mm^2$ and a modulus of elasticity of $54\times10^3$ $kgf/mm^2$.

EXAMPLE 3

To propionic acid as the solvent were added 0.15 mole of p-toluenesulfonic acid (PTS) as the catalyst and 0.15 mole of formalin expressed in terms of formaldehyde as the crosslinking agent to prepare a solution to be used for the subsequent reaction.

Thereafter, 3 g of the mesophase pitch fiber as obtained in the preceding Example 2 was immersed in the above solution to effect reaction at 120° C. for 5 hours, then taken out from the solution and dried at 130° C. under vacuum to afford infusibilized fiber at a yield of infusibilization of 100% by weight.

The infusibilized fiber was graphitized at 2500° C. to produce graphitized fiber having 9.5 μm diameter at a yield of 81% by weight.

The graphitized fiber thus obtained had a tensile strength of 370 kgf/mm$^2$ and a modulus of elasticity of $64\times10^3$ kgf/mm$^2$.

COMPARATIVE EXAMPLE 1

The optically isotropic pitch fiber same as that used in Example 1 was oxidized by heating up to 300° C. in the air at a heat-up rate of 0.1° C./min.

The oxidized fiber thus obtained was heated up to 800° C. in a stream of nitrogen. As the result, the fiber was molten without preserving the fibrous shape.

COMPARATIVE EXAMPLE 2

The mesophase pitch fiber same as that used in Example 2 was heated up to 300° C. in the air at a heat-up rate of 1.8° C./min to produce infusiblized fiber at a yield of 106.7% by weight.

The infusibilized fiber was graphitized at 2500° C. to produce graphitized fiber having 9.9 μm diameter at a yield of 88% by weight.

The graphitized fiber thus obtained had a tensile strength of 307 kgf/mm$^2$ and a modulus of elasticity of $56\times10^3$ kg·f/mm$^2$.

The results obtained from Examples 2 to 3 and Comparative Example 2 are collectively given in Table 1.

TABLE 1

| | Example 2 | Example 3 | Comparative Example 2 |
|---|---|---|---|
| Yield of infusiblization (wt %) | 96 | 100 | 106.7 |
| Yield of graphitization (wt %) | 80 | 81 | 88 |
| Tensile strength (kgf/mm$^2$) | 343 | 373 | 307 |
| Modulus of elasticity ($10^3$ kgf/mm$^2$) | 54 | 64 | 56 |

What is claimed is:

1. A process for producing pitch-based carbon fiber which comprises the steps of melt spinning a raw material pitch to form pitch fiber; subjecting said pitch fiber to oxidative polymerization in a solvent selected from the group consisting of acetic acid, propionic acid and butyric acid in the present of a Lewis acid catalyst and a formaldehyde monomer source selected from the group consisting formalin, paraformaldehyde, trioxane and compounds each having a hydroxy methyl group to form infusibilized fiber under polymerization conditions comprising a polymerization temperature of 90°-150° C. and a polymerization time of 0.1-10 hours; and thereafter carbonizing said infusibilized fiber.

2. The process according to claim 1 wherein the raw material pitch comprises an optically isotropic pitch as a principal component.

3. The process according to claim 1 wherein the raw material pitch comprises a mesophase pitch as a principal component.

4. The process according to claim 1 wherein the Lewis acid catalyst is selected from the group consisting of sulfuric acid, nitric acid, hydrochloric acid, phosphoric acid and p-toluene sulfonic acid.

5. The process according to claim 1 wherein the raw material pitch comprising an optically isotropic pitch as a principal component is subjected to oxidative polymerization in the acidic solvent in the presence of acid catalyst in an amount of 0.0025 to 0.125 mole per 1 g of the optically isotropic pitch fiber and the formaldehyde monomer source in an amount of 0.05 to 0.25 mole per 1 g of the optically isotropic pitch fiber.

6. The process according to claim 1 wherein the raw material pitch comprising a mesophase pitch as a principal component is subjected to oxidative polymerization in the acidic solvent in the presence of the acid catalyst in an amount of 0.0001 to 0.05 mole per 1 g of the mesophase pitch fiber and the formaldehyde monomer source in an amount of 0.0001 to 0.05 mole per 1 g of the mesophase pitch fiber.

* * * * *